US007866960B2

(12) United States Patent
Parng

(10) Patent No.: US 7,866,960 B2
(45) Date of Patent: Jan. 11, 2011

(54) PERISTALTIC PUMP

(75) Inventor: Shaw-Hwa Parng, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 318 days.

(21) Appl. No.: 11/389,744

(22) Filed: Mar. 27, 2006

(65) Prior Publication Data

US 2007/0134113 A1 Jun. 14, 2007

(30) Foreign Application Priority Data

Dec. 9, 2005 (TW) ..... 94143721 A

(51) Int. Cl.
*F04B 43/12* (2006.01)

(52) U.S. Cl. ..... 417/477.5; 417/476; 417/477.9; 417/474; 417/477.3

(58) Field of Classification Search ... 417/477.1–477.8, 417/474, 476, 478, 479, 477.9, 477.11, 477.14
See application file for complete search history.

(56) References Cited

U.S. PATENT DOCUMENTS 4,095,923 A * 6/1978 Cullis ..... 417/475
4,132,509 A * 1/1979 Bongartz et al. ..... 417/475
4,228,930 A * 10/1980 Hogan ..... 222/212
4,518,327 A * 5/1985 Hackman ..... 417/477.3
4,976,590 A * 12/1990 Baldwin ..... 417/53
5,266,013 A * 11/1993 Aubert et al. ..... 417/474
5,380,173 A 1/1995 Hellstrom
6,655,934 B2 * 12/2003 Mittelstein et al. ..... 417/477.9
2007/0104599 A1 5/2007 Michels et al.

FOREIGN PATENT DOCUMENTS

EP 1356866 A2 10/2003
JP 7151062 A 6/1995
TW 357234 5/1999
TW 403143 Y 8/2000
TW 507839 Y 10/2002
TW 590795 B 6/2007
WO 2005031166 A1 4/2005

* cited by examiner

*Primary Examiner*—Devon C Kramer
*Assistant Examiner*—Christopher Bobish
(74) *Attorney, Agent, or Firm*—Volpe and Koenig PC

(57) ABSTRACT

A hose compressed peristaltic pump is provided. The pump includes a base, a sidewall structure mounted on the base, and forming a containing space therein, a rotor having a center in the space and further having plural integral protrusions, and a hose disposed between the protrusions and the sidewall structure.

17 Claims, 6 Drawing Sheets

PERISTALTIC PUMP

FIELD OF THE INVENTION

The present invention is related to a peristaltic pump, in particular a hose compressed peristaltic pump.

BACKGROUND OF THE INVENTION

The pump is used to transfer fluid, especially the liquid. In the Flow Injection Analysis (FIA), the most broad used is the peristaltic pump, which is a dynamic analysis that can analyze the tested materials without waiting for complete reaction. The advantages of the peristaltic pump are that it not only could provide steady and continuous fluid driving, but is cheap, simple to operate and easy to change the tube. Such properties are appropriate for the industries in need of precise liquid supplying, such as the pharmaceutical industry, the electronics industry, the environmental analysis, the medical apparatus, the biochemical experiment, and the cell culture, etc.

The peristaltic pump plays a very important rule in each field described above. By the different driving modes the peristaltic pump can be classified to the diaphragm peristaltic pump, the thermopneumatic peristaltic pump, and the hose compressed peristaltic pump. The membrane peristaltic pump needs complex manufacture and the production cost thereof is expensive; the thermopneumatic peristaltic pump drives fluid by the different heat, but some fluids are not appropriate in this way; the hose compressed peristaltic pump drives fluid by compressing the hose which has a lower production cost compared to the above two modes and is the mostly used.

Now, the peristaltic pumps in the market are usually very big in volume, e.g. EYELAMP-3N has 12 cm long, 13 cm wide, and 18.6 cm high and has 3 kg weight, and further it costs almost thousand US. Although these kinds of peristaltic pumps have multiple functions, but for the medical apparatus and biochip applications, they need neither so many functions nor so big flow volume and speed. Oppositely, what these industries need is a peristaltic pump which can easily and stably drive the fluid to flow forward, reverse, and stop. It is what the new-style peristaltic pumps want to achieve. Moreover, if the new peristaltic pump can be so cheap, easy to compose, slight for carry, and save power, the application fields will be much broader. However, the conventional peristaltic pumps cannot achieve all the requirements described above simultaneously, so the investigation of the present invention has been promoted.

The working theory of the hose compressed peristaltic pump uses two motions, compressing and releasing the hose, to drive the liquid. The conventional peristaltic pump compresses the liquid filling hose through the wheels. The hose between the two wheels are filled with the liquid, and therefore, when the wheels roll and change the compressing positions, the liquid in the hose is pushed to another position. When the wheels release the hose, the hose will restore to the pipe shape and the hollow condition to produce a vacuum attraction so as to discharge the liquid. As above, it is known that the hoes compressing peristaltic pump uses the wheels to compress and release the hose to produce a vacuum attraction so as to drive the liquid.

Please refer to FIG. 1, which is a conventional passive planet rolling pump. The pump comprises a pump head 1, and the hose 2 surrounds the pump head 1 and is compressed thereby. Additionally, the pump head 1 has a rotor 12 in the center for accepting the rolling of a motor (not shown) and a turntable 10 with plural wheels 14. The peristaltic pump uses the wheels 14 to compress the hose 2 to form a liquid storage space 20 between two wheels 14*a* and 14*b*. The turntable 10 rolling makes the wheels 14 orbit and change the compressing position in the hose 2, and also makes the liquid storage space move in the hose 2. When the wheel 14*b* orbits and moves toward the wheel 14*c*, the wheel 14*b* will release the hose 2. The hose 2 will restore and produce a vacuum attraction to make the liquid in the liquid storage space 20 move toward the transportation direction A. By the conventional pump in FIG. 1, each wheel 14 is passively rolled by the resistance of the hose 2 to compress the hose 2 smoothly and push the liquid forward. Moreover, in the miniaturized hose compressed peristaltic pump, because the pump drives less liquid, it only needs the small size hose 2, which results in the small size of the turntable 10 and the wheel 14. Therefore, the size of the wheel 14 is too small, i.e. the diameter of the wheel 14 reduces a lot, which also means the strength distance is shirt, so the strength applied on the wheel 14 surface should be very big to achieve enough torque. Nevertheless, the resistance between the hose 2 and the wheel 14 is not sufficient and the wheel 14 with the small diameter has too short strength distance to get enough torque to make the wheel roll. So the miniaturized peristaltic pump combined with the small hose usually has the problem that the wheel is not rolling and just slides and rubs the hose. Therefore, in the miniaturized peristaltic pump, the wheel has almost no function, but the cost and the assembling difficulty are increased.

The description above shows that it urgently needs a light-weight, miniaturized, low-cost, and easily-assembled hose compressed peristaltic pump, which still has the forward and reverse flow driving function.

SUMMARY OF THE INVENTION

To achieve the aspect described above, the present invention provides a hose compressed peristaltic pump, which comprises a base, a sidewall structure mounted on the base, and forming a containing space therein, a rotor having a center in the space and further having plural integral protrusions, and a hose disposed between the protrusions and the sidewall structure.

According to the peristaltic pump described above, wherein the protrusions surround the center.

According to the peristaltic pump described above, wherein the hose is pressed by the protrusions to toward the sidewall structure.

According to the peristaltic pump described above, wherein adjacent two of the protrusions form a gradual shrinking caved portion facing toward the center.

According to the peristaltic pump described above, wherein the sidewall structure and the protrusions form a peristaltic space wherein the hose is located.

According to the peristaltic pump described above, wherein the peristaltic space is gradually extending toward the base.

According to the peristaltic pump described above, wherein an outside diameter of the rotor is gradually tapering toward the base.

According to the peristaltic pump described above, wherein a sidewall of the containing space is gradually extending toward the base.

According to the peristaltic pump described above, wherein the base has a power source inside, and the power could be electric power, manual power, or pneumatic power.

To achieve the aspect described above, the present invention provides a rotor having a center and applied in a peristaltic pump system, which comprises plural integral protrusions surrounding the center, plural caved portions, each located between respective adjacent two of the plural protrusions, wherein the plural caved portions gradually shrink toward the center.

According to the rotor described above, wherein the plural protrusions are arc.

According to the rotor described above, wherein the plural caved portions are arc and inward.

According to the rotor described above which is gradually extending outward from the center.

According to the rotor described above, further comprising an up-stopping portion.

According to the rotor described above which is in a form of a stair along the center.

To achieve the aspect described above, the present invention further provides an apparatus for a peristaltic pump system, which comprises a rotor having a center and plural integral protrusions surrounding the center and a sidewall structure surrounding the rotor and forming a peristaltic space therebetween for containing a hose, wherein the protrusions compressing the hose toward the sidewall structure.

According to the apparatus described above, wherein the peristaltic space further extends into the rotor.

According to the apparatus described above, wherein a cross-section of the peristaltic space extending into the rotor is square.

According to the apparatus described above, wherein a cross-section of the peristaltic space extending into the rotor is arc.

According to the apparatus described above, wherein the peristaltic space further extends toward the rotor and the sidewall structure.

According to the apparatus described above, wherein a cross-section of the peristaltic space is one of a protruded square-shape and a protruded arc-shape.

According to the apparatus described above which further comprises a base supporting the sidewall structure.

According to the apparatus described above, wherein the peristaltic space gradually extends toward the base.

According to the apparatus described above, wherein a block portion is set in one of the rotor and the sidewall structure far from the base.

According to the apparatus described above, wherein either of the rotor and the hose has a number being at least two.

DETAILED DESCRIPTION OF THE PREFERRED EMBODIMENT

The present invention will now be described more specifically with reference to the following embodiments. It is to be noted that the following descriptions of preferred embodiments of this invention are presented herein for purposes of illustration and description only; it is not intended to be exhaustive or to be limited to the precise form disclosed.

The present invention provides a hose compressed peristaltic pump with the advantages of small volume, lightweight, easy assembling, and low cost. Besides, it still can be easily operated to drive liquid to flow forward and reversely.

Figure 2:
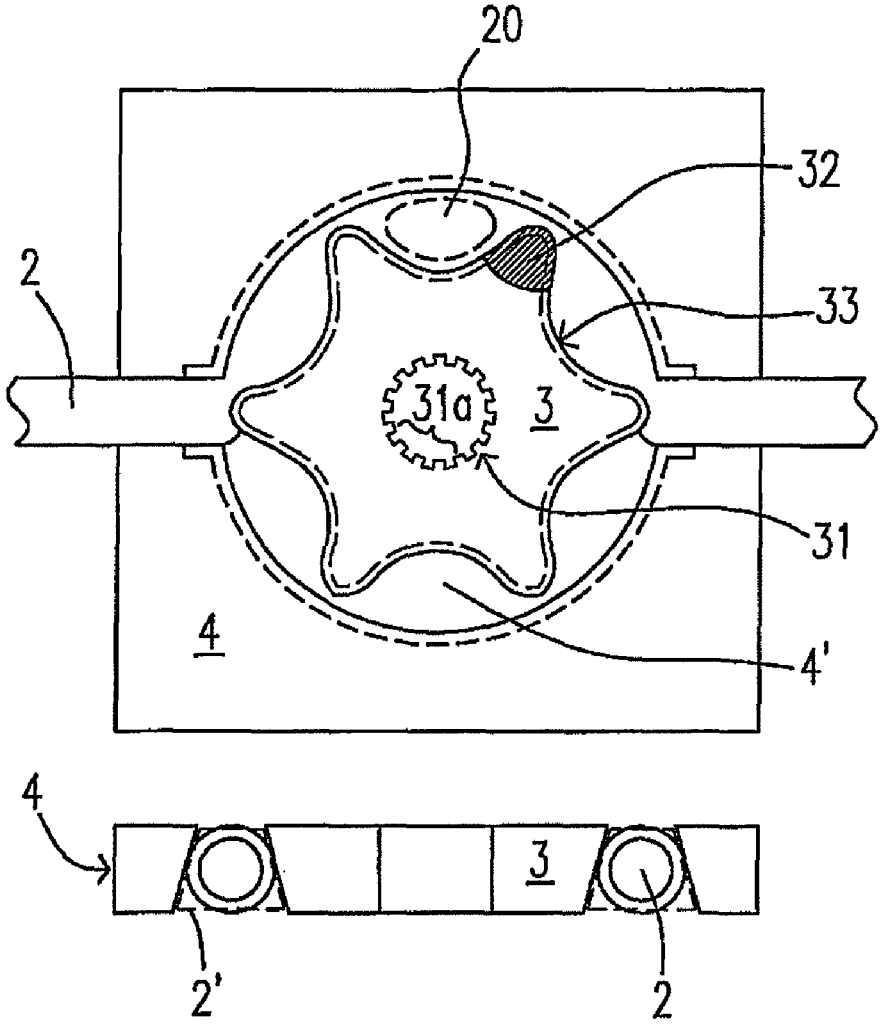
FIG. 2 is a practical illustration of the present invention.

Please refer to FIG. 2, which is a practical illustration of the present invention in top view. The present invention features a rotor 3 with a center 31, which forms at least one tightly wedged structure 31*a* inward wedging with a power source (not shown, usually an electronic motor). Moreover, plural integral protrusions are formed radio-like with the center 31*a* and the position between each protrusion is sunken toward the center 31 and formed a cave portion 33. Furthermore, a sidewall structure 4 surrounds the rotor 3, i.e. the sidewall structure 4 has a containing space 4' for containing the rotor 3, forming a peristaltic space 2' therebetween. A hose 2 is disposed in the peristaltic space 2' and compressed by the rotor 3 to be closed to the sidewall structure 4. The inner part of the hose 2 between the two protrusions 32 forms a liquid storage space 20, i.e. the position of the cave portion 33. When the rotor 3 is rolling, the protrusions 32 are rolled with the circumference of the rotor 3 and pushes the liquid storage space 20 to change its position toward the direction in need of the liquid supporting. Therefore, the foregoing and FIG. 2 show that in the present invention, the plural protrusions 32 are formed together with the rotor 3 and compress the hose 2 to urge against the sidewall structure 4, i.e. the liquid in the hose 2 is pushed and transported directly by the protrusions 32. Because the present invention features the miniaturized and lightweight peristaltic pump, the hose 2 is also in small size and causes the small resistance in the contact site between the hose 2 and the protrusions 32. The protrusions 32 are sliding on the hose 2 surface, i.e. it scrapes the hose 2 surface. Discarding the conventional wheel and directly compressing the hose 2 by the rotor 3, of course, the wheel failing problem would not occur and a simpler and stronger peristaltic pump structure would be obtained. Also, because of giving up the wheel, in the assembling of the peristaltic pump, when the sidewall structure 4 and the hose 2 are disposed, the rotor 3 is disposed into the containing space 4' and the integral protrusions 32 on the rotor 3 are closely compressing the hose 2 appropriately. Because the protrusions 32 and the rotor 3 are formed together, there is no need to worry about the cooperation therebetween. Because the shape of the rotor 3 is formed by injection molding, if the mold has no problem, the size, the position, and the tolerance of the protrusions 32 will meet the standard.

Figure 1:
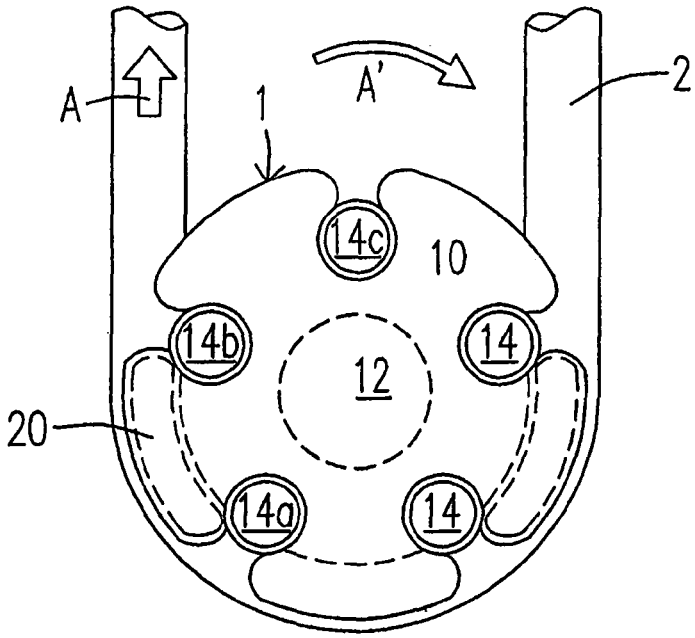
Fig. 1 (PRIOR ART)
FIG. 1 is a conventional passive planet rolling pump.

Please refer to the wheel 14 on the conventional rotor 1 shown in FIG. 1. When the wheel 14 is disposed on the rotor 1, it also needs to notice if the positions are precise. If the hose 2 is not compressed by the wheel 14 center, either of the two sides of the wheel 14 will suffer too much pressure and receive more damage, resulting in abnormal operation of the wheel 14. When the harmful situation occurs, the component should be changed, which is inconvenient for a yearly running facility.

Figure 3:
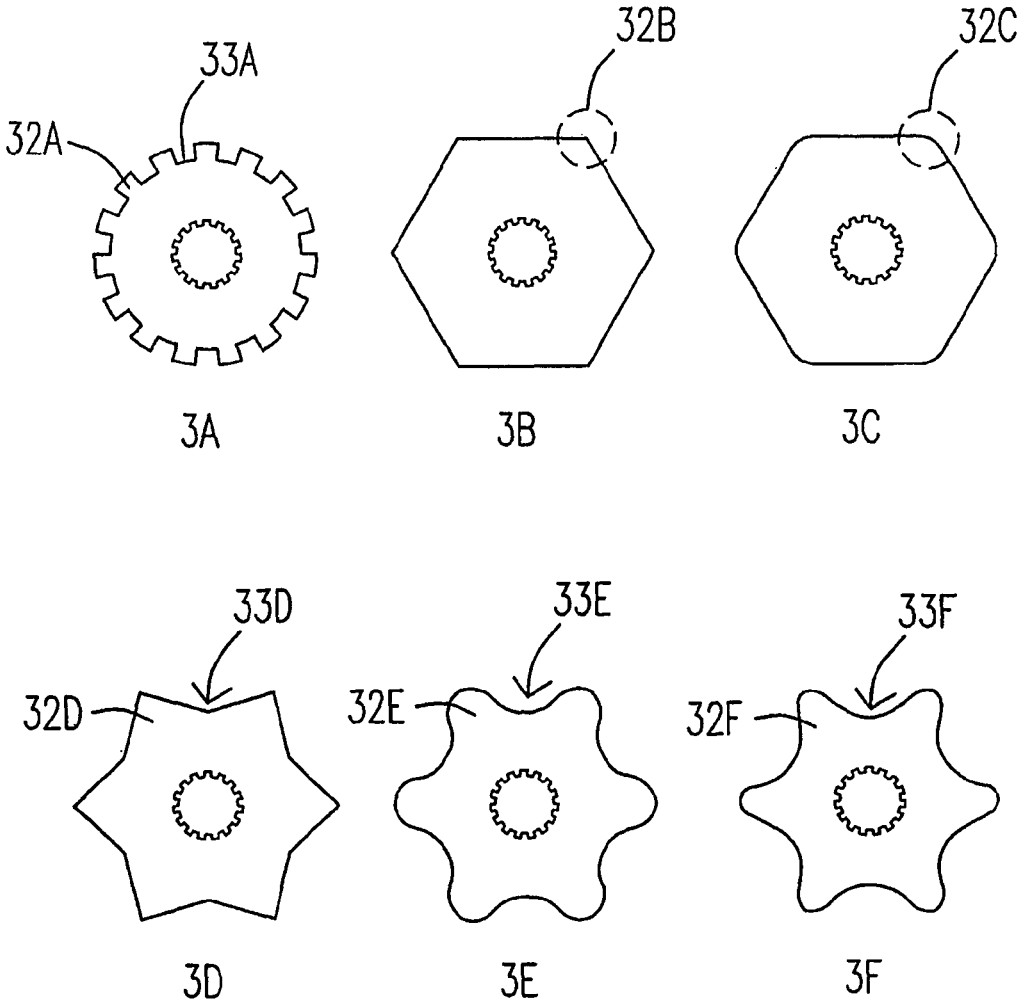
FIG. 3 is a top view of the rotor of the present invention.

Please refer to FIG. 3, which is a top view of the rotor of the present invention. As shown in FIG. 3, six different rotors with various shapes are disclosed therein. First, please refer to the rotor 3A, wherein the protrusions 32A and the cave portions 33A compose the shape similar to the gear wheel. The rotor 3B shapes as a hexagon, wherein the protrusions 32B are the acmes of the hexagon and no obvious cave portions exist. Each protrusion 32 is linked with each other by a straight line. The rotor 3C is formed by replacing the sharp acmes in the rotor 3B with the arc protrusions 32C. Please refer to the rotor 3D, which shapes as hexagram, wherein the protrusions 32D are sharp and the cave portions 33D is formed between each protrusion 32D. The protrusions 32D are straightly tapering in radiated direction, and the cave portions 33D are straightly tapering toward the center. Please refer to the rotor 3E, in which, no matter the protrusions 32E or the cave portions 33E shape arc, wherein the protrusions 32E shape arc for the purpose that when the protrusions 32E are compressing the hose 2 (please cooperatively refer to FIG. 2), the arc shape will make the pressure dispersed without excessively gathered in the acme of the protrusions 32E and damaging the hose by abrasion. Please refer to the rotor 3F, wherein the protrusions 32F and the cave portions 33F are almost the same as the rotor 3E, but, for compressing the hose 2, only the farthest extremity needs to contact the hose 2. Besides, when the liquid storage space 20 is released (please cooperatively refer to FIG. 2), i.e. the time and the position for pushing the liquid to leave the pump, the needed space is the bigger the better. Therefore, compared to the rotor 3E, the rotor 3F reduces the width of the protrusions 32F that makes the width of the cave portions 33F increase. Thus, the volume of the liquid storage space 20 and the space produced by the released hose are increased, making the liquid have enough buffers. It is known from the foregoing phenomenon that the rotors 3A to 3D are able to force the liquid in the hose to move by the mechanical power, but the efficiency is bad due to the not big enough releasing space provided by the rotors 3A to 3D. With regard to the rotor 3F, the protrusions 32F and the cave portions 33F are all arcs and have their own curvature radius, wherein, it is better if the curvature radius of the protrusions 32F is smaller than that of the cave portions 33F.

Figure 4:
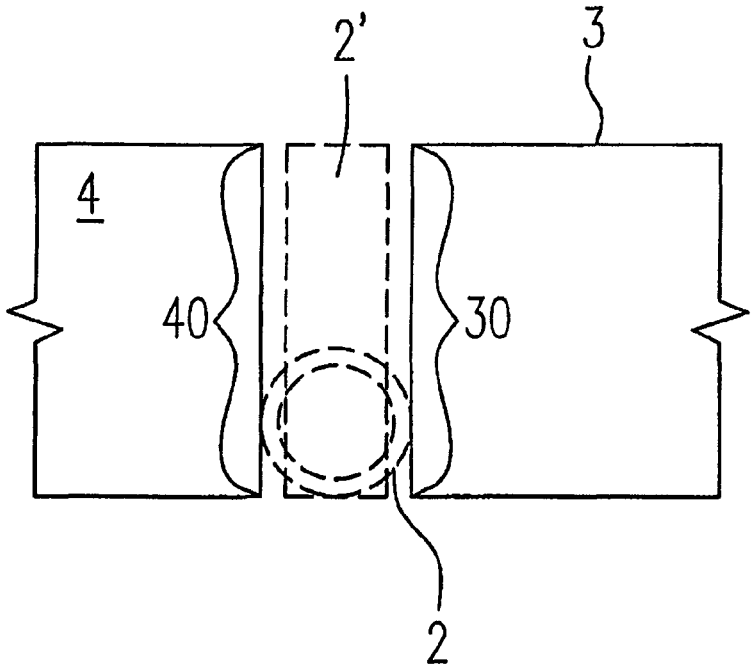
FIG. 4 shows the relevant positions of the rotor and the sidewall structure of the present invention.

Please refer to FIG. 4, which illustrates the relevant positions of the rotor and the sidewall structure of the present invention. This drawing shows in the side cross-sectional view to disclose the relevant positions therebetween. The edge portion 30 of the rotor 3 and the inner wall 40 of the sidewall structure 4 form a peristaltic space 2', which is used to dispose the hose 2 therein. In the peristaltic space 2', the hose 2 is compressed to change shape by the protrusions 32 of the rotor 3 and the sidewall structure 4. The un-compressed portion of the hose 2 forms the liquid storage space 20 (please cooperatively refer to FIG. 2) in the cave portion 33. When the rotor 3 rolls, the protrusions 32 and the edge portion 30, the parts of the rotor 3, of course, are rolling with the rotor 3 and compress the hose 2 to push liquid storage space 20 forward.

Figure 5:
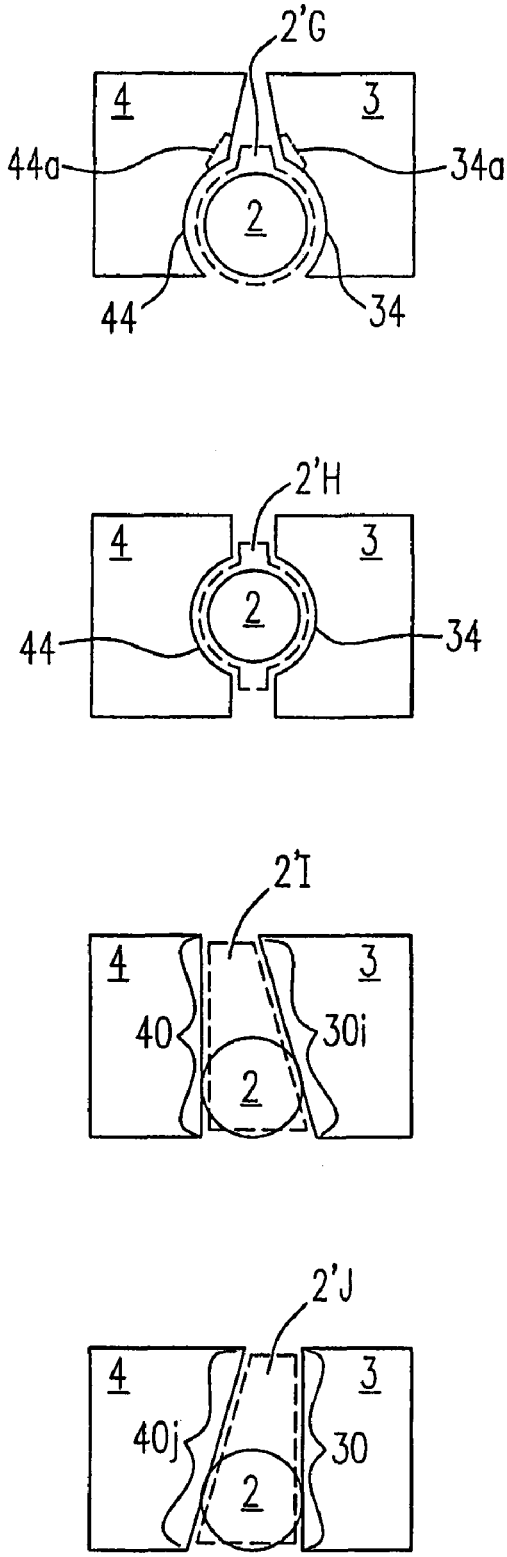
FIG. 5 is a practical illustration of the rotor and the sidewall structure of the present invention.

Please refer to FIG. 5, which illustrates the practice of the rotor and the sidewall structure of the present invention. The peristaltic space 2' in FIG. 4 is formed by the edge portion of the rotor 3 and the inner wall 40 of the sidewall structure 4. The hose 2 is compressed by the edge portion 30 and the inner wall 40 to become flat, and then the rotor 3 twists and makes the protrusions 32 not to compress the hose 2, making the hose 2 released in the position of the cave portions 33 (please cooperatively refer to with FIG. 2). In the process of repeated dilation and compression, the hose 2 might probably depart from the peristaltic space 2' gradually. If the edge portion 30 and the inner wall 40 are formed vertically, the situation that the hose 2 departs from the peristaltic space 2' while the pump is running may happen. Therefore, to give enough dilation space to the hose 2, the present invention brings up an idea to make the peristaltic space 2' extend toward the rotor 3, the sidewall 4, or both. Thus, when the hose extends by its own elasticity, it will enter the extension peristaltic space without departing from the topside of the peristaltic space.

Please refer to FIG. 5 continuously, based on the idea described above, for matching up with the peristaltic space 2'G extending toward the rotor 3 and the sidewall structure 4, a first containing space 34 is set in the rotor 3 and a second containing space 44 is set in the sidewall structure 4. It means that the first containing space 34 and the second containing space 44 are set for matching up the peristaltic space 2' extending toward left and right. So, the hose 2 can find enough space in the first containing space 34 and the second containing space 44 and won't move toward the topside of the peristaltic space 2' due to compression or release. Furthermore, the first containing space 34 and the second containing space 44 are a kind of extending inward structure, so the topside structures 34*a* and 44*a* thereof also have a preventing function. When the hose 2 is moving upward, the topside structures 34*a* and 44*a* will stop it in the peristaltic space 2'G Besides, for further preventing the hose 2 form departing, the peristaltic space 2'G is formed by gradually shrinking toward the topside, i.e. the rotor 3 relevant to the topside thereof is very close to the sidewall 4, wherein the thickness is even smaller than the compressed hose 2. This design further prevents the hose 2 from departing from the peristaltic space 2'G through the topside thereof.

Please refer to FIG. 5 continuously, wherein the peristaltic space 2'H is simply extending toward the rotor 3 and the sidewall structure 4 and forms a first containing space 34 in the rotor 3 and a second containing space 44 in the sidewall structure 4. These two containing spaces are formed with arcs as shown in FIG. 5, which can also be the square or the polygon.

Please refer to FIG. 5 continuously, wherein the peristaltic space 2'I is formed with a narrow top and a broad bottom, i.e. the width of the bottom of the peristaltic space 2'I is bigger than that of the top thereof. Therefore, for the peristaltic space 2'I, the peripheral portion of the rotor 3 is tapering downward gradually around the axis of the center 31 and makes the peristaltic space 2'I as the taper shape. So, in the cross-sectional view of the peristaltic space 2'I, the edge potion 30*i* of the rotor 3 is sloped and slopes toward the inner wall 40 of the sidewall structure 4. Therefore, when the hose 2 is compressed by the protrusions 32 (please cooperatively refer to FIG. 2), the forward strength applied from the protrusions 32 to the hose 2 is not only toward the inner wall 40 but also downward to maintain the hose 2 staying in the peristaltic space 2'I without departing therefrom.

Please refer to FIG. 5 continuously, wherein the peristaltic space 2'J is formed with a narrow top and a broad bottom, i.e. the width of the bottom of the peristaltic space 2'J is bigger than that of the top thereof. Therefore, for the peristaltic space 2'J, the inner wall 40 of the sidewall structure 4 is extending downward gradually around the axis of the center 31 and makes the peristaltic space 2'J as the taper shape. So, in the cross-sectional view of the peristaltic space 2'J, the inner wall 40 is sloped and slopes toward the rotor 3. Therefore, when the hose 2 is compressed by the protrusions 32 (please cooperatively refer to FIG. 2), the forward strength applied from the protrusions 32 to the hose 2 is not only toward the inner wall 40 but also downward to maintain the hose 2 staying in the peristaltic space 2'J without departing therefrom.

Figure 6:
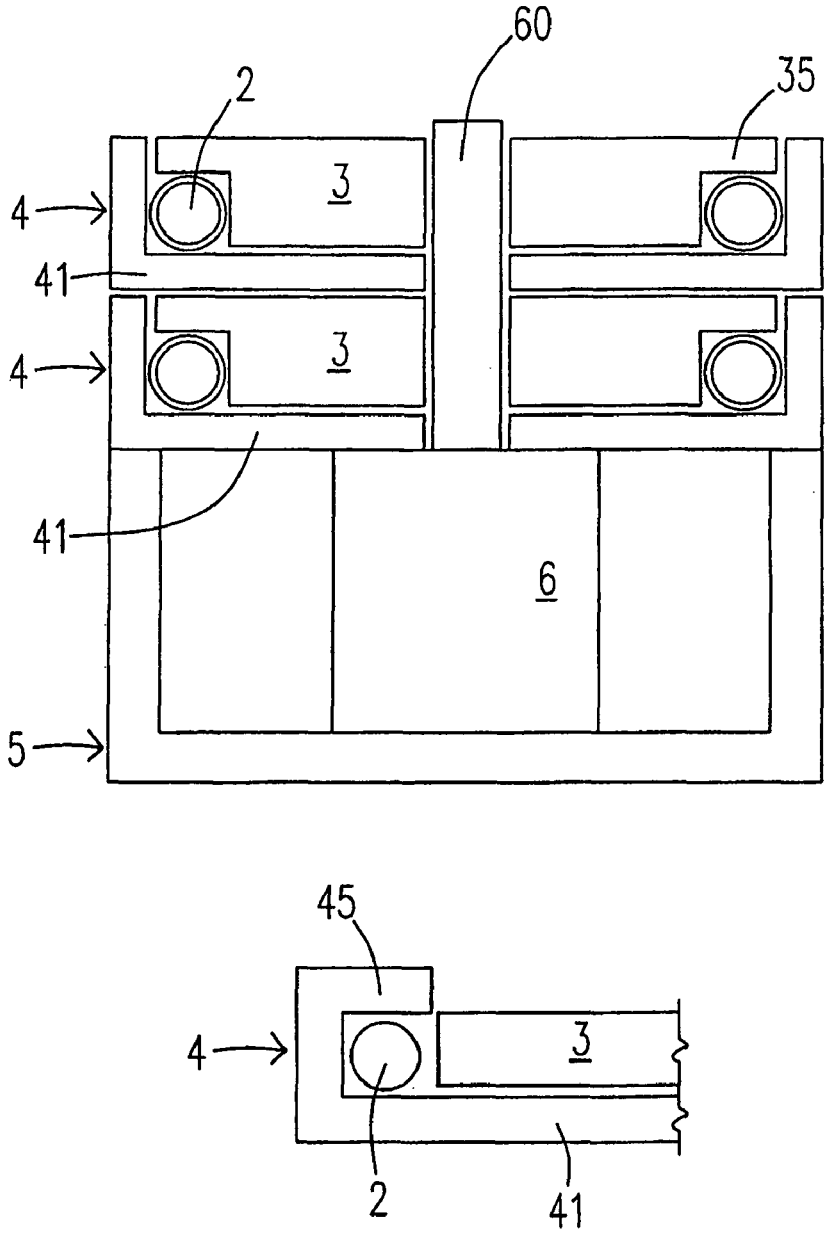
FIG. 6 is another practical illustration of the present invention.

Please refer to FIG. 6, which illustrates another practice of the present invention. Wherein, there are two rotors 3 used in stack. As shown in FIG. 6, a rotor 3 and a sidewall structure 4 are used as a set. Therefore, FIG. 6 shows the two sets, which are used in stack. Besides, the bottom sidewall structure 4 is mounted on a base 5, wherein the base 5 contains a power source 6, which usually is an electronic motor with a transmission shaft 60 passing through the bottom board 41 and fixed with the tightly wedged structure 31*a*, through which the rotors 3 are rolled by the transmission shift 60. Moreover, the rotor is rolling on the bottom board 41, so the underside of the hose 2 is restricted by the bottom board 41. So, for preventing the hose 2 from departing in the peristaltic process, a first block portion 35 is set in the topside peripheral of the rotor 3, i.e. the side far away from the bottom board 41, covering the topside thereof for preventing the hose 2 from departing. The rotor 3 and the sidewall structure 4 respectively compress the left and right sides of the hose 2 to produce peristalsis. The topside and the underside of the hose 2 are respectively restricted by the first block portion 35 and the bottom board 41, so the hose 2 is fixed stably. Additionally, a structure which is similar to the first block portion 35 is also able to be set on the sidewall structure 4. It is a second block portion 45 as illustrated in FIG. 6. In this practice, the bottom board 41 and the second block portion 45 fix the hose 2 respectively by the top and under sides for preventing the hose 2 from departing. As shown in the cross-sectional view, the first block portion 35 and the second block portion 45 are similar to the stair shape.

From the above illustration and drawings, the present invention provides a peristaltic pump that is helpful to be applied in the small flowing volume. The plural protrusions and the cave portions of the present invention are formed together with the rotor and there is a cave potion between the two protrusions, i.e. there is a protrusion between the two cave potions. When the hose is compressed directly by the two protrusions, the position of the hose in the cave portion without the compression will keep the original hollow shape by its own elasticity, and a liquid storage space is formed thereby. When the rotor is rolling, the protrusions and the cave portions twist therewith, of course. So, when the protrusions change their positions, the compressed sites in the hose are changed and then the positions of the liquid storage space are changed. It also means that the present invention pushes the liquid storage space forward directly by the protrusions integrated with the rotor, rather than transmitting the rotor's twisting by the wheel according to the prior art. The present invention not only simplifies the assembling of the peristaltic pump, but also makes the wheel failing problems disappear because of the wheel discarding. Furthermore, the protrusions are integrated with the rotor, so the rotor's twisting is directly transmitted to the hose by the protrusions. The problems of the inefficient peristalsis or the liquid storage space leaking in the prior art due to the wheel damage or the wrong positions will not happen again. Accordingly, the present invention discloses a rotor of the hose compressed peristaltic pump with the integral protrusions, which directly compresses the hose by the protrusions, making the power transmission more certainly and the forward or reverse liquid driving more precisely. The hose compressed peristaltic pump of the present invention has simple conformation and is not easily damaged, which is better than the prior art in not only the simple manufacture but also the much excellent mechanical performance. Therefore, the present invention is sufficient to replace the hose compressed peristaltic pump with the wheels in the prior art.

While the invention has been described in terms of what is presently considered to be the most practical and preferred embodiment, it is to be understood that the invention needs not be limited to the disclosed embodiment. On the contrary, it is intended to cover various modifications and similar arrangements included within the spirit and scope of the appended claims, which are to be accorded with the broadest interpretation so as to encompass all such modifications and similar structures.

What is claimed is:

1. A peristaltic pump system, comprising:

a base;

a sidewall structure mounted on the base, and forming a containing space therein;

a rotor having a rotational axis and a center in the containing space, and further having plural protrusions formed as a single piece with the center, wherein the sidewall structure and the protrusions form a peristaltic space in the containing space; and a hose disposed in the peristaltic space formed between the protrusions and the sidewall structure, wherein the peristaltic space has a top and a bottom, the top and the bottom being defined on a same plane in a direction parallel to the rotational axis of the rotor, the top is displaced from the base, and the bottom is located closer to the base than the top, and a first distance between the sidewall structure and the rotor at the bottom of the peristaltic space is greater than a second distance between the sidewall structure and the rotor at the top of the peristaltic space.

2. A peristaltic pump system as claimed in claim 1, wherein the protrusions surround the center.

3. A peristaltic pump system as claimed in claim 1, wherein the hose is pressed by the protrusions toward the sidewall structure.

4. A peristaltic pump system as claimed in claim 1, wherein two adjacent ones of the protrusions form a gradual shrinking caved portion therebetween, which faces toward the center.

5. A peristaltic pump system as claimed in claim 1, wherein the peristaltic space is gradually extending toward the base.

6. A peristaltic pump system as claimed in claim 1, wherein a sidewall of the containing space is gradually extending toward the base.

7. A peristaltic pump system as claimed in claim 1, wherein the base has a power source inside.

8. An apparatus for a peristaltic pump system, comprising: a rotor having a rotational axis and a center and plural protrusions formed as a single piece with the center and surrounding the center; and a sidewall structure surrounding the rotor and forming a peristaltic space therebetween for containing a hose, wherein the protrusions compress the hose toward the sidewall structure, and the peristaltic space has a top and a bottom, the top and the bottom being defined on a same plane in a direction parallel to the rotational axis of the rotor, the top is displaced from a base, and the bottom is located closer to the base than the top, and a first distance between the sidewall structure and the rotor at the bottom of the peristaltic space is greater than a second distance between the sidewall structure and the rotor at the top of the peristaltic space.

9. An apparatus as claimed in claim 8, wherein a cross-section of the peristaltic space extending into the rotor is square shaped.

10. An apparatus as claimed in claim 8, wherein a cross-section of the peristaltic space extending into the rotor is arc shaped.

11. An apparatus as claimed in claim 8, wherein a cross-section of the peristaltic space is has an arc-shape.

12. An apparatus as claimed in claim 8 further comprising the base supporting the sidewall structure.

13. An apparatus as claimed in claim 12, wherein the peristaltic space gradually extends toward the base.

14. An apparatus as claimed in claim 12, wherein a block portion is set in one of the rotor and the sidewall structure far from the base.

15. An apparatus as claimed in claim 8, wherein at least two of the rotor or the hose are provided.

16. A peristaltic pump, comprising: a base; a sidewall structure mounted on the base, and forming a containing space therein; and a rotor having a rotational axis and a center in the space, and further having plural protrusions formed as a single piece with the center, wherein the sidewall structure and the protrusions form a peristaltic space in the containing space, the peristaltic space has a top and a bottom, the top and the bottom being defined on a same plane in a direction parallel to the rotational axis of the rotor, the top is displaced from a base, and the bottom is located closer to the base than the top, and a first distance between the sidewall structure and the rotor at the bottom of the peristaltic space is greater than a second distance between the sidewall structure and the rotor at the top of the peristaltic space.

17. The peristaltic pump of claim 1, wherein the top of the peristaltic space is displaced from the base and the bottom of the peristaltic space is located closer to the base than the top when measured in an axial direction of the rotor.

* * * * *